United States Patent [19]

Abe

[11] Patent Number: 4,726,917

[45] Date of Patent: Feb. 23, 1988

[54] WATER CURRENT AND AIR BUBBLE GENERATING APPARATUS FOR BATH

[75] Inventor: Masaki Abe, Osaka, Japan

[73] Assignee: Abe, Co., Ltd., Osaka, Japan

[21] Appl. No.: 888,492

[22] Filed: Jul. 23, 1986

[30] Foreign Application Priority Data

Jul. 23, 1985 [JP] Japan ..... 60-113320[U]
Jun. 19, 1986 [JP] Japan ..... 61-94450[U]

[51] Int. Cl.[4] ..... A61H 33/02

[52] U.S. Cl. ..... 261/36.1; 4/542; 128/66; 261/DIG. 75

[58] Field of Search ..... 4/542, 541, 544; 128/66; 261/36.1, 121 M, DIG. 75

[56] References Cited

U.S. PATENT DOCUMENTS

| | | | |
|---|---|---|---|
| 2,533,936 | 12/1950 | Holmes et al. | 261/121 M |
| 2,938,517 | 5/1960 | Friend | 4/544 |
| 3,085,576 | 4/1963 | Rocke | 128/66 |
| 3,092,101 | 6/1963 | Kinney | 4/541 |
| 3,273,560 | 9/1966 | Jacuzzi | 128/66 |
| 3,411,499 | 11/1968 | Jacuzzi | 4/542 |
| 3,474,469 | 10/1969 | Steltz | 4/544 |
| 3,534,730 | 10/1970 | Jacuzzi | 128/66 |
| 3,641,996 | 2/1972 | Friend | 128/66 |
| 3,806,964 | 4/1974 | Vanegas et al. | 4/542 |
| 3,902,529 | 9/1975 | Brown | 4/541 |
| 3,911,505 | 10/1975 | Zaborowsky | 4/544 |
| 4,255,360 | 3/1981 | Jeffries | 261/121 M |
| 4,340,039 | 7/1982 | Hibbard et al. | 4/542 |
| 4,563,782 | 1/1986 | Dijkhuizen | 4/542 |

FOREIGN PATENT DOCUMENTS

| | | | |
|---|---|---|---|
| 434931 | 9/1935 | United Kingdom | 4/544 |

*Primary Examiner*—Tim Miles
*Attorney, Agent, or Firm*—Birch, Stewart, Kolasch & Birch

[57] ABSTRACT

A pump 120 contained in a first case 9 sucks hot water 13 in a bathtub 1 through an inlet 12 and pushes the hot water 13 upward through an outlet pipe 14 above the water surface 16. The outlet pipe 14 is coupled to jet nozzles 15, so that the hot water is shot out from the jet nozzles 15 toward the water surface 16. At this time, countless air bubbles are generated in the hot water. The first case 9 and the second case 20 together with the pump 10, a motor 11, the outlet pipe 14, the jet nozzles 15 etc. contained in these cases are installed integrally as a unitary body which is transportable.

9 Claims, 16 Drawing Figures

WATER CURRENT AND AIR BUBBLE GENERATING APPARATUS FOR BATH

BACKGROUND OF THE INVENTION

1. Field of the Invention

The present invention relates to a water current and air bubble generating apparatus for bath and particularly to an apparatus for generating air bubbles in the hot water in a bathtub by sending jet current of water thereto.

2. Description of the Prior Art

Recently, various bathing methods have been developed for the purpose of securing good health. As one of them, there is known a bathing method using a water current and air bubble generating apparatus in which countless fine air bubbles are generated by sending jet current of water into the hot water. It is known that the above stated air bubbles produce the same effect as the ultrasonic wave in a frequency range of 20 to 40 KHz, whereby various healthful effects such as warming, massage and washing are brought about. Such a conventional water current and air bubble generating apparatus is generally structured in a manner in which a pump driven by a motor sucks up the hot water in a bathtub and returns it as jet current into the hot water in the bathtub. Such a conventional water current and air bubble generating apparatus 90 for bath is installed in a bathroom by fixing it to the wall 2 or the like of the bathroom by means of screws or the like, as shown in FIG. 15.

However, since the conventional water current and air bubble generating apparatus 90 for bath is installed fixedly onto the wall or the like of a bathroom as described above, installation work is required and it takes much time and involves considerable cost.

In addition, when jet currents are shot out from the jet nozzles of the conventional water current and air bubble generating apparatus 90 for bath, there is produced such a loud noise that a person in the bathroom can hardly hear what another person in the bathroom is saying. In order to reduce this noise, a cylinder 4 is provided to surround each jet nozzle 3 as shown in FIG. 16. More specifically, as shown in FIG. 16, a gap 5 is formed between each cylinder 4 and the circumference of the associated jet nozzle 3 so that air flows into each cylinder 4 from the inside of the main body case 6. The lower end of each cylinder 4 is preferably located at a level a little lower than the water surface 7 in the bathtub 1 so that the noise deadening effect can be secured. Those cylinders 4 serve to decrease the noise produced by the collision of the jet currents with the water surface 7 to such a degree that conversation in the bathroom can be made without inconvenience.

However, once the conventional water current and air bubble generating apparatus shown in FIG. 16 has been installed, the height of the jet nozzles 3 and the height of the cylinders 4 can not be changed. Consequently, it is difficult to always position the lower ends of the cylinders 4 at a level a little lower than the water surface according to the change of the water surface 7 and therefore, it is difficult for the cylinders 4 to always exhibit the sound deadening effect.

SUMMARY OF THE INVENTION

The present invention has been accomplished in view of the above described problems and it is an object of the present invention to provide a water current and air bubble generating apparatus for bath which does not require any installation work.

Briefly stated, the present invention is a water current and air bubble generating apparatus comprising: a motor; a pump driven by this motor; an inlet connected to this pump; and outlet pipe having one end connected to an outlet of the pump; and jet nozzles connected to prescribed portions of the outlet pipe. This apparatus is transportable and can be installed in a manner in which the above stated components are not fixed to any part of a bathroom.

These objects and other objects, features, aspects and advantages of the present invention will become more apparent from the following detailed description of the present invention when taken in conjunction with the accompanying drawings. However, it should be understood that the detailed description and specific examples, while indicating preferred embodiments of the invention, are given by way of illustration only, since various changes and modifications within the spirit and scope of the inveniton will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
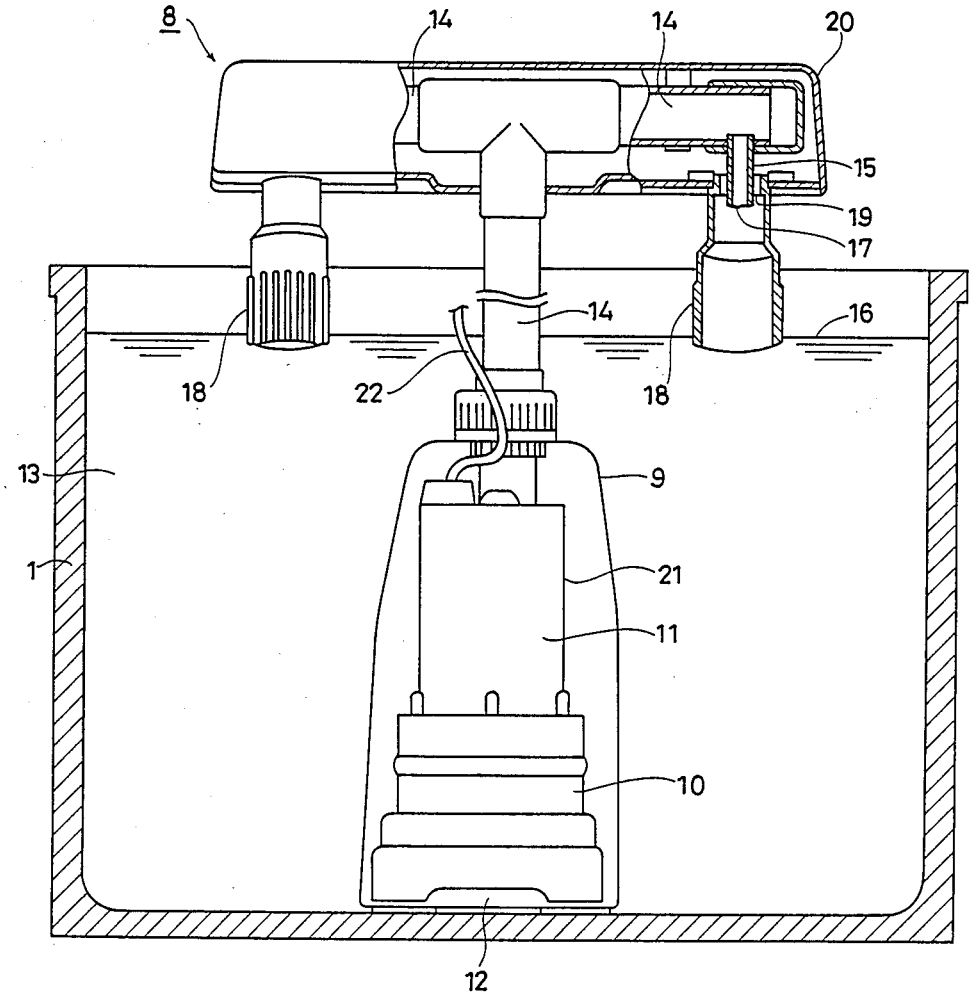
FIG. 1 is a front view of an embodiment of the present invention.
Figure 2:
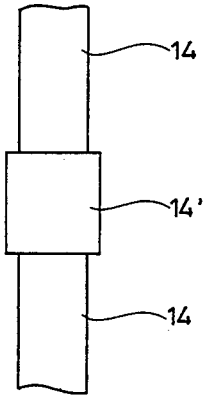
FIG. 2 is an illustration showing an expansion joint portion of an outlet pipe 14 shown in FIG. 1.
Figure 3:
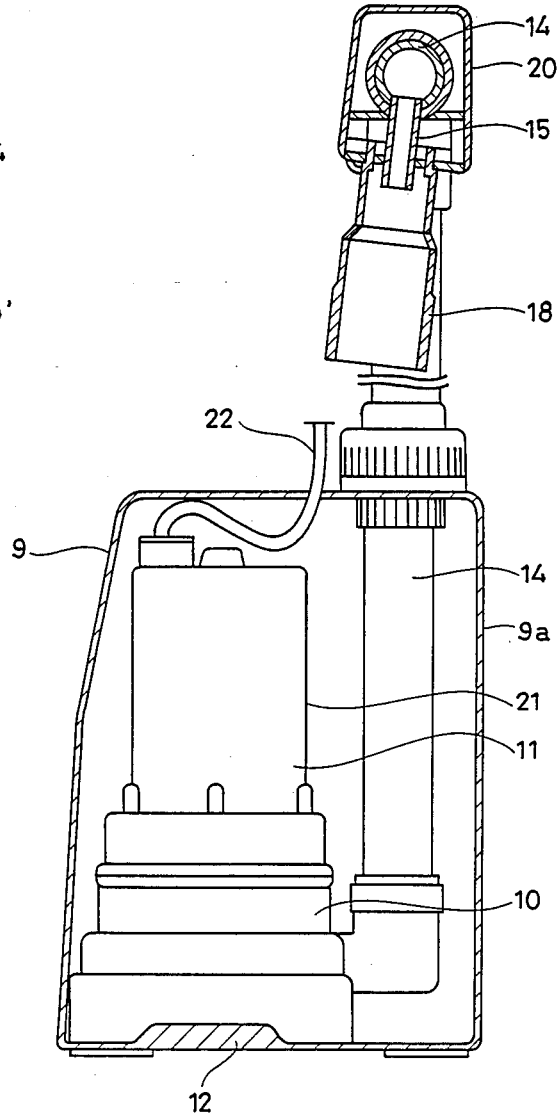
FIG. 3 is a right side view of the embodiment shown in FIG. 1.
Figure 4:
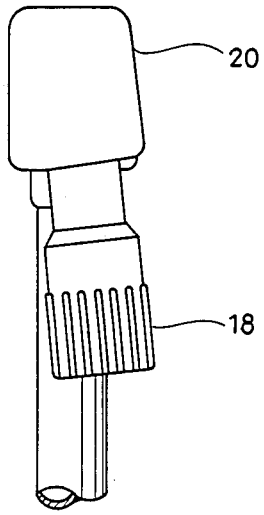
FIG. 4 is an enlarged side view of a second case and a cylinder in the embodiment shown in FIG. 1.
Figure 5:
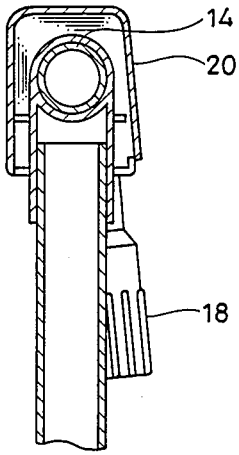
FIG. 5 is a longitudinal side sectional view of the second case and the cylinder shown in FIG. 1.
Figure 15:
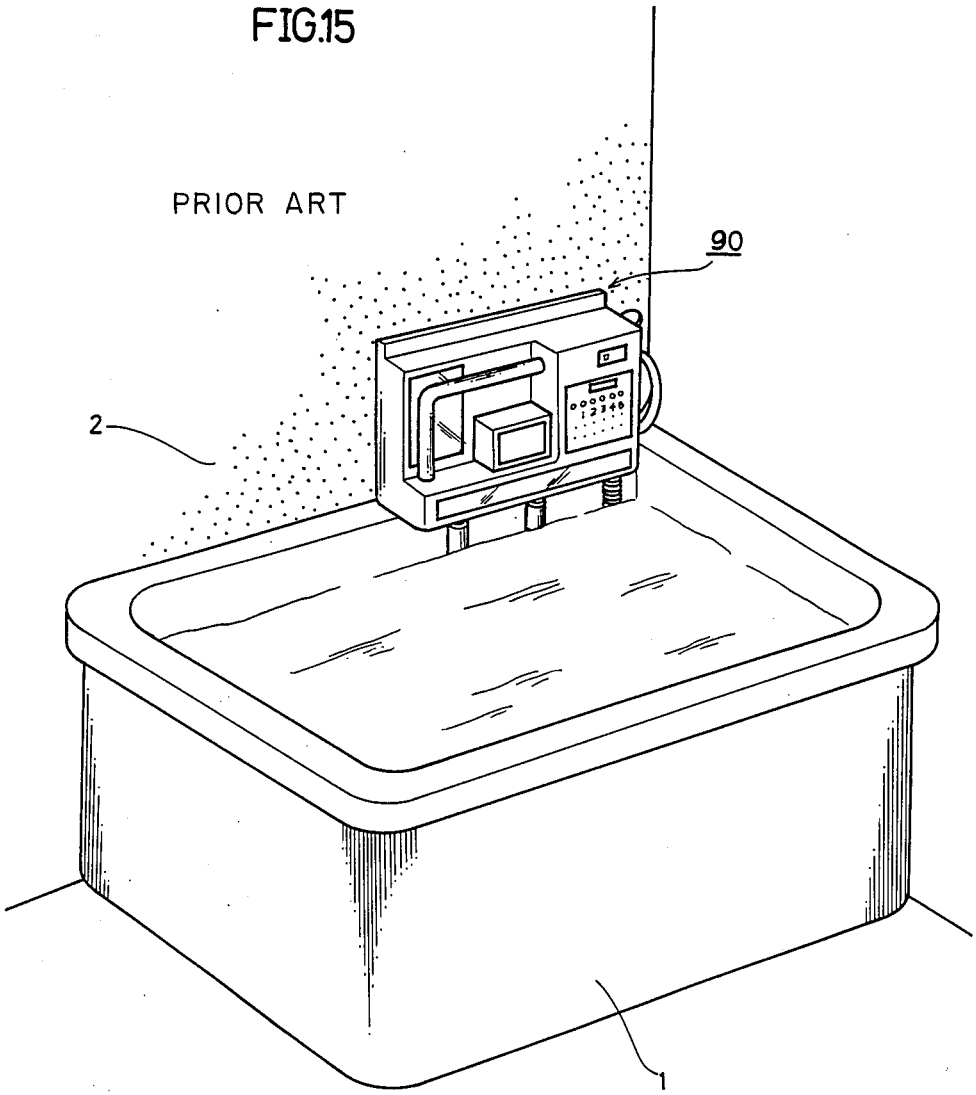
FIG.15 PRIOR ART
FIG. 15 is a perspective view of a conventional apparatus.
Figure 16:
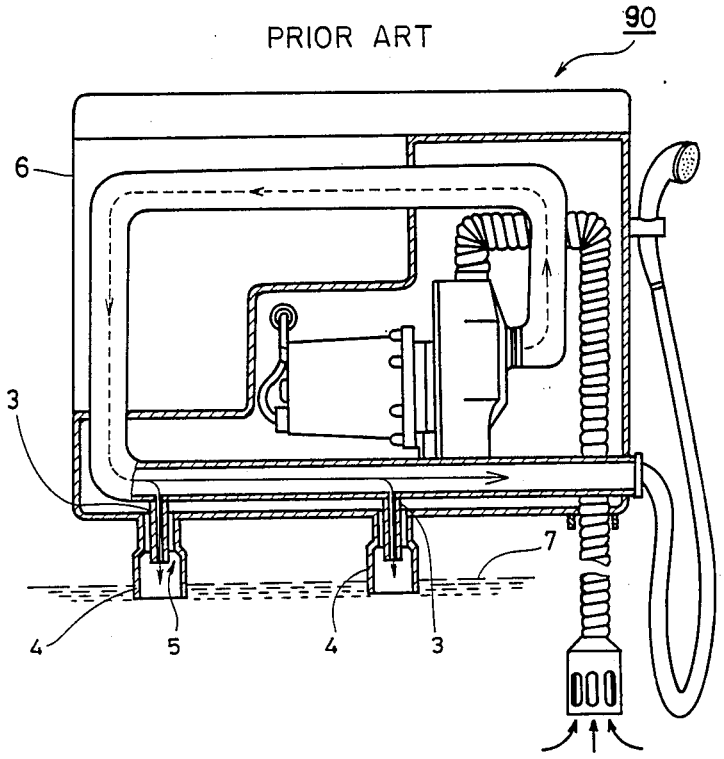
FIG.16 PRIOR ART
FIG. 16 is a sectional view of a conventional apparatus.

FIG. 1 is a front view showing an embodiment of the present invention. FIG. 3 is a right side sectional view of the embodiment of the present invention. Referring to FIG. 1, an water current and air bubble generating apparatus 8 is placed in a bathtub 1 in a movable manner. The water current and air bubble generating apparatus 8 comprises a first case 9. The first case 9 contains a pump 10 mounted on a pump base. This pump 10 is driven by a motor 11. The pump 10 and the motor 11 need not be contained in the first case 9. They may be placed outside the first case 9 and connected to an inlet 12 in the first case 9. For example, the pump 10 may be placed movably on an edge of the bathtub and the first case 9 may be placed movably in the bathtub. Otherwise, the first case 9 may be hung in a detachable manner onto the wall, the side surface of the bathtub or the like. Although the first case 9 is provided in the above described embodiment, this first case 9 may be omitted. The pump 10 is connected with the inlet 12. The inlet 12 may be located at any position in the first case 9 as far as the inlet 12 can suck up the hot water in the bathtub. The hot water 13 in the bathtub 1 is drawn from the inlet 12. An outlet (not shown) of the pump 10 is connected with one end of an outlet pipe 14. A lower portion of the outlet pipe 14 extends upward along the inner side of the back surface 9*a* of the first case 9 and is connected at an intermediate position with an upper portion of the outlet pipe 14 extending downward from a second case 20, as shown in FIG. 3. Jet nozzles 15 are provided in the above stated outlet pipe 14 as shown in FIG. 1. These jet nozzles 15 serve to provide jet currents to the water surface 16. The tip portion 17 of each of the jet nozzles 15 is located at a level higher than the water surface 16. The one or more jet nozzles 15 may be provided. The jet nozzles 15 may be formed integrally with the outlet pipe 14 as a unitary body, or they may be prepared as components separate from the outlet pipe 14 and connected with the outlet pipe 14 at the time of assembling. Further, as shown in FIG. 1, a cylinder 18 is provided to surround each jet nozzle 15. The cylinders 18 serve to reduce the noise caused when jet currents collide with the water surface 16. A gap 19 is formed between each cylinder 18 and the outer circumference of the associated jet nozzle 15 so that air flows into each cylinder 18 from the second case 20. The outlet pipe 14 which connects the first case 9 and the second case 20 is formed in an expansible and contractible manner with a watertight state being maintained. However, the outlet pipe 14 may be formed in a fixed manner, not in an expansible or contractible manner. In order to make the outlet pipe 14 expansible and contractible, a plurality of pipe portions having equal or different diameters in section may be connected by using one or more expansion joints 14' such as corrugated expansion joints or sliding joints. By expanding or contracting the outlet pipe 14 vertically, the positions of each jet nozzle 15 and each cylinder 18 can be moved vertically so that the lower end of each cylinder 18 can be located at a level a little lower than the water surface 16 in the bathtub 1. Thus, the positions of each jet nozzle 15 and each cylinder 18 can be adjusted according to the level of the water surface 16 which may change at any time. Consequently, the cylinders 18 can always secure the sound deadening effect. In addition, since the expansion joint 14' is provided, the second case 20 can be rotated about the outlet pipe 14, whereby each jet nozzle can be moved to a desired position. It is also possible to adjust the positions of each jet nozzle 15 and each cylinder 18 by adjusting the level of the water surface without using the above stated expansion joint 14'. The jet nozzles 15 and the cylinders 18 are inclined with the lower ends thereof being projected forward as shown in FIG. 4 (which shows a left side view) and FIG. 5 (which shows a left side sectional view). As a result, jet current shot out from each jet nozzle 15 does not hit the wall of the bathtub and serves to accelerate the circulation of water in the bathtub, thereby to generate much more air bubbles. However, the jet nozzles 15 and the cylinders 18 need not be inclined in the above described manner. Referring to FIG. 1, the motor 11 is contained in the motor case 21 and this motor case 21 is covered with a bracket (not shown) so that a completely watertight state is assured. As the watertight means, any other means may be used. The motor 11 is connected with a cord 22, which is maintained in a watertight state and drawn out from a side surface of the motor case 21 to the exterior. The cord 22 drawn out from the first case 9 is led outside the bathroom through a hole (not shown) bored in the wall 2 (shown in FIG. 15) of the bathroom. Then, the cord 22 is connected to a power supply circuit provided outside the bathroom. Mechanical seal for example is used to maintain the motor 11 in a perfectly watertight state and thus occurrence of an electrical leakage accident can be completely prevented.

An absorptive board or a flat plate may be attached to the bottom of the first case 9 so that the water current and air bubble generating apparatus for bath can be placed stably.

Figure 6:
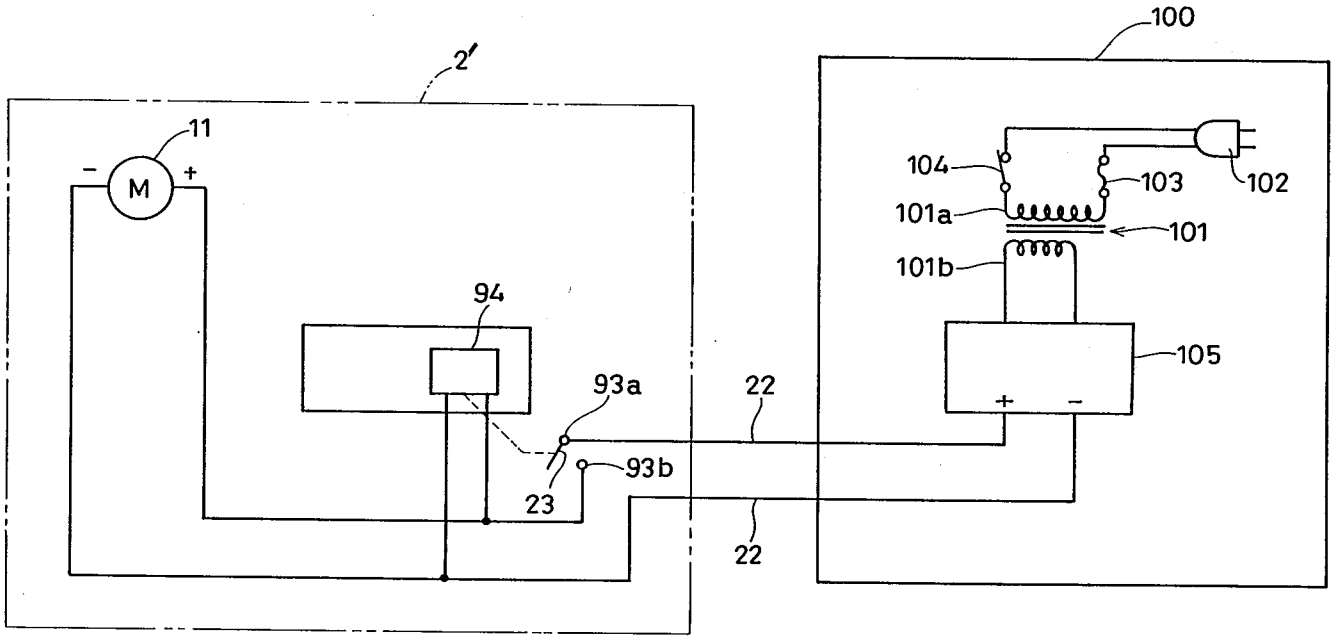
FIG. 6 is a schematic block diagram showing an electrical circuit portion of the embodiment of the present invention.

FIG. 6 is a schematic block diagram showing an electric circuit portion of the above described embodiment. Referring to FIG. 6, the power supply circuit 100 is provided outside the bathroom 2'. This power supply circuit 100 comprises an isolating transformer 101, which has a primary coil 101*a* connected to a plug 102. A fuse 103 and a power switch 104 are provided between the plug 102 and the primary coil 101*a*. A secondary coil 101*b* of the isolating transformer 101 is connected to a rectifying circuit 105. An output terminal of the rectifying circuit 105 is connected with one end of the above stated cord 22. The other end of the cord 22 is drawn into the bathroom. The plus line of the cord 22 connected to the plus output terminal of the rectifying circuit 105 is connected to a terminal 93*a* of a switch 23. The switch 23 is operated by an on-off switch 94 (not shown in FIG. 1 since it is provided on the second case 20 shown in a fragmentary manner), so that two terminals 93*a* and 93*b* are connected. The terminal 93*b* is connected to one end of a luminous lamp contained within the on-off switch 94 and further connected to the plus terminal of the motor 11. On the other hand, the minus line of the cord 22 connect to the minus output terminal of the rectifying circuit 105 is connected to the on-off switch 94 and further connected to the minus terminal of the motor 11.

Now, operation of the above described embodiment will be described. First of all, the flexible outlet pipe 14 shown in FIG. 1 is moved vertically to regulate the position of the lower end of the cylinder 18 so that this position is fixed at a level a little lower than the water surface 16 in the bathub. Then, as shown in FIG. 6, the plug 101 is put into a commercial power source (not shown) and the power switch 105 is turned on. As a result, AC voltage is induced in the secondary coil 101*b* of the isolating transformer 102 and the rectifying circuit 104 rectifies the AC voltage to DC voltage. The switch 23 is turned on by the ON-OFF switch 94 and the terminals 93*a* and 93*b* are connected. Consequently, the output of the retifying circuit 105 is supplied to on-off switch 94 and the motor 11. Thus, the motor starts to rotate. By the rotation of the motor 11, the pump 10 is driven. In consequence, the hot water 13 in the bathtub 1 is sucked up through the inlet 12 and supplied to the pump 10. The pump 10 feeds the hot water 13 supplied through the inlet 12 to the outlet pipe 14. As a result, the hot water flows in the outlet pipe 14 so as to shoot out from the tip portion 17 of each jet nozzle 15. The hot water 13 thus shooting out is thrown onto the water surface 16 with air in the vicinity being drawn thereinto. As a result, countless fine air bubbles are generated in the hot water 13. When these air bubbles are bursted, a wave is generated to bring about various healthful effects such as warming, massage and washing. Then, referring to FIG. 6, when the on-off switch 94 is pressed again, the switch 23 is turned off so that the motor 11 stops rotating. The above stated on-off switch 94 may be provided with a timer mechanism.

Thus, in the above described embodiment, the power supply circuit 100 is provided in a place other than the bathroom and accordingly such an accident as leakage of electricity due to splashes of hot water 13 onto the power supply circuit 100 can be completely prevented. In addition, since the isolating transformer 101 is provided in the power supply circuit 100 to make insulation between the commercial power source and the water current and air bubble generating apparatus 1 and to step down the voltage of the commercial power source, a serious danger to life can be completely prevented even if leakage of electricity occurs in the water current and air bubble generating apparatus 1.

Although a DC motor is used as the motor 11 in the above described embodiment, an induction motor or the like may be used instead and in such case, the rectifying circuit 105 can be omitted.

Figure 7:
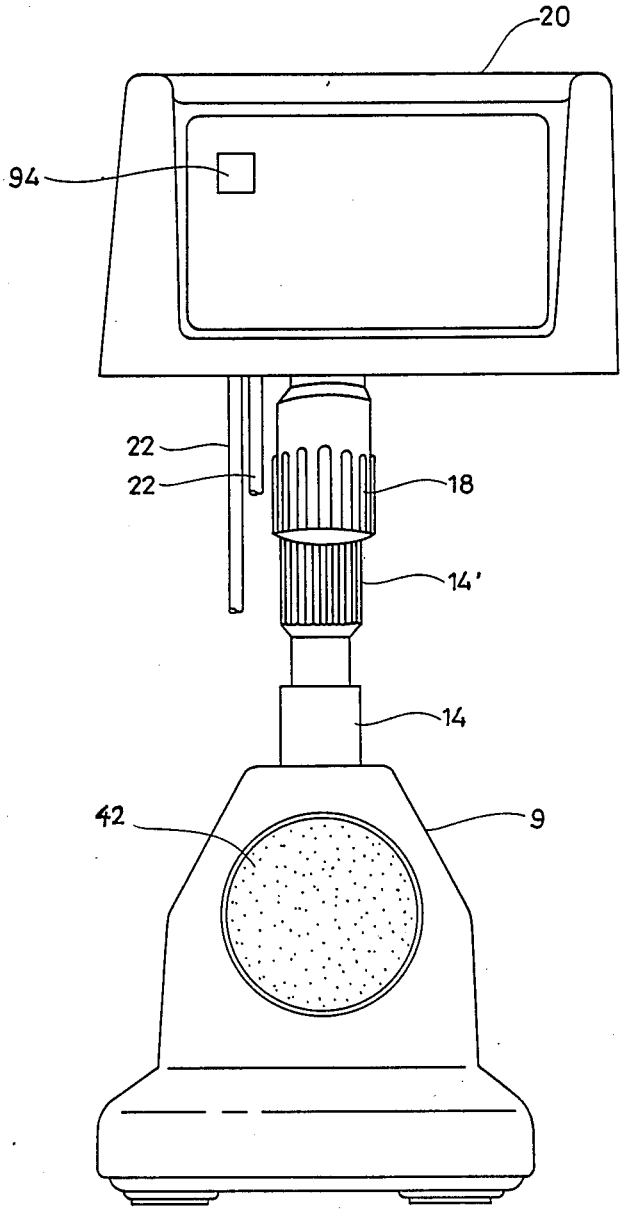
FIG. 7 is a front view showing another embodiment of the present invention.
Figure 8:
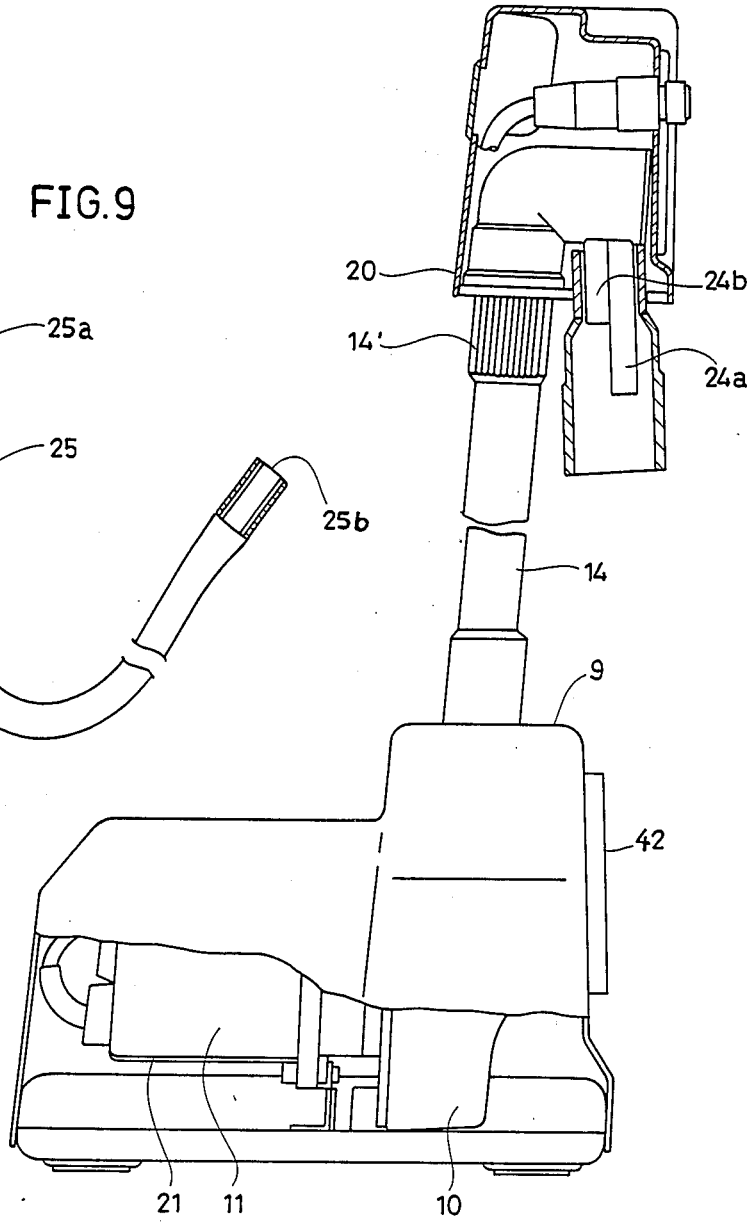
FIG. 8 is a left side view of the embodiment shown in FIG. 7.
Figure 9:
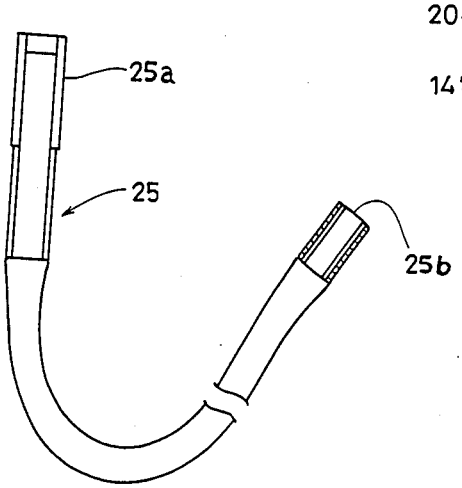
FIG. 9 is a side view of a pressure hose.
Figure 10:
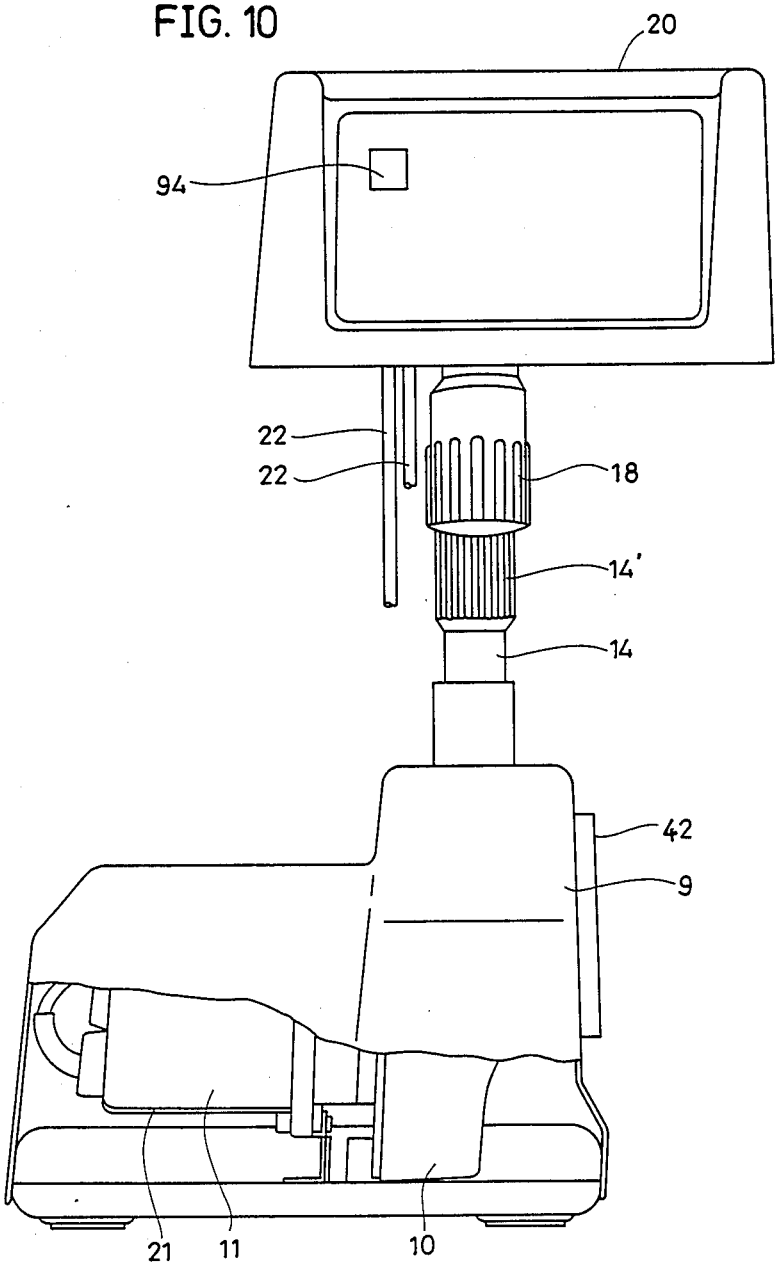
FIG. 10 is a left side view showing a state in which the second case of the embodiment shown in FIG. 7 is rotated.

FIG. 7 shows another embodiment of the present invention and FIG. 8 shows a left side view thereof. In this embodiment, there are provided two jet nozzles 24*a* and 24*b* having different lengths inside the cylinder 18 as shown in FIG. 8. It is to be understood, however, that those two jet nozzles may have the same length or may be provided in parallel with a spacing. The upper end 25*a* of a pressure hose 25 shown in FIG. 9 is connected to either of the two jet nozzles 24*a* and 24*b* so that the upper end 25*a* covers the tip portion of the jet nozzle 24*a* (or 24*b*) or is fitted to the contrary into the jet nozzle 24*a* (or 24*b*). In this manner, the hot water flowing in the jet nozzle 24*a* (or 24*b*) shoots out through the nozzle 25*b* of the pressure hose 25. Since the inner diameter of the pressure hose 25 is made relatively small, the hot water shoots out forcefully from the nozzle 25*b*. If a person in the bathtub positions his body so as to be hit by the hot water thus shooting out, healthful effects such as warming, massage and washing can be obtained. Furthermore, as shown in FIGS. 7 and 8, the inlet 42 is provided on the side surface of the first case 9 in this embodiment. Since the outlet pipe 14 is provided with the expansion joint 14' in this embodiment as well, the second case 20 can be rotated around the outlet pipe 14 as an axis and thus the direction of the second case 20 can be changed as desired, as shown in FIG. 10, for example.

Figure 11:
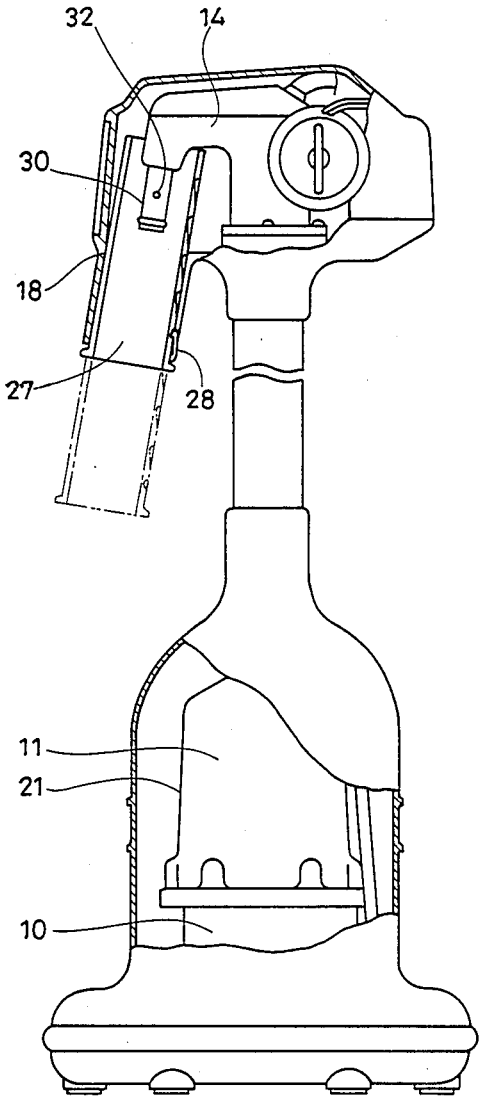
FIG. 11 is a partial sectional view of a further embodiment of the present invention.
Figure 12:
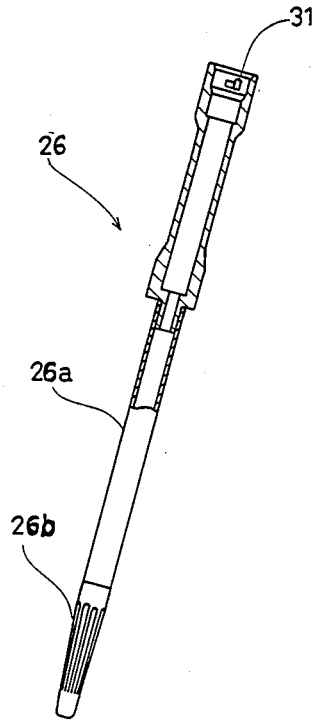
FIG. 12 is a partial sectional view of another pressure hose.
Figure 13:
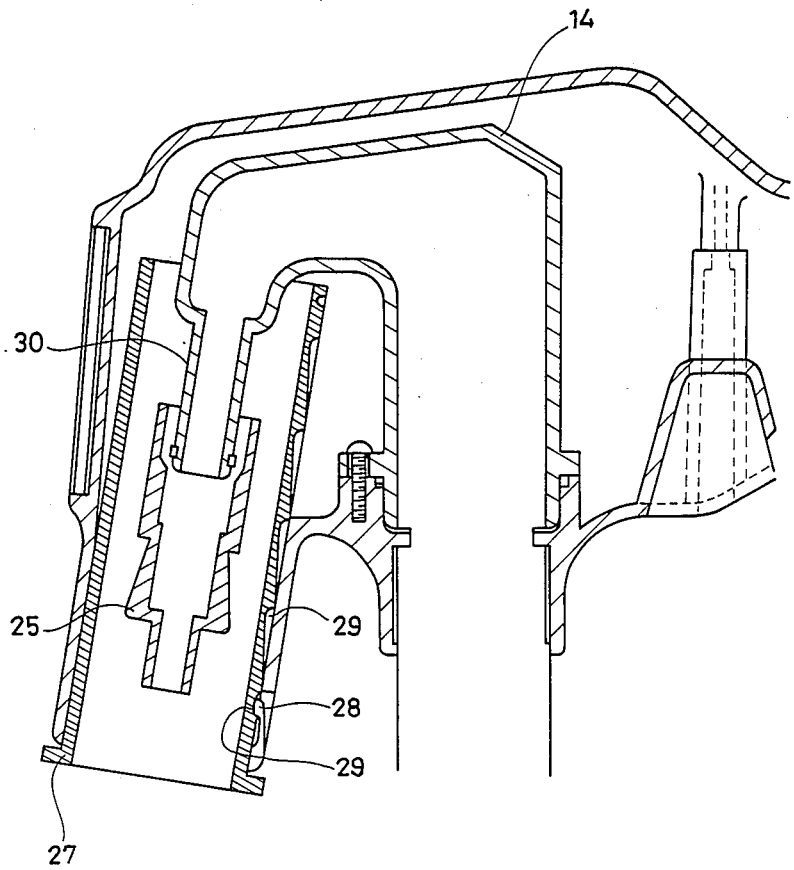
FIG. 13 is an enlarged sectional view of a portion in FIG. 11.

FIG. 11 shows a further embodiment of the present invention. FIG. 13 is an enlarged partial sectional view thereof. In this embodiment, a slidable noise silencer 27 is provided inside the cylinder 18. The slidable noise silencer 27 is fixed in a manner in which a claw 28 provided on the inner wall of the cylinder 18 fits into one of the grooves 29 formed on the outer wall of the slidable noise silencer 27. When the lower end of the slidable noise silencer 27 is pulled downward, the claw 28 is slipped off from the above stated groove and is engaged in another one of the grooves 29 provided at higher positions than the above stated groove. Thus, positioning of the slidable noise silencer 27 can be made by steps. In this manner, the lower end of the slidable noise silencer 27 can be located at a level a little lower than the water surface, whereby the sound deadening effect can be obtained. Instead of the above stated slidable noise silencer 27, a noise silencer of a non-slidable type, for example, an attachment type noise silencer may be used. In addition, a pressure hose 26 as shown in FIG. 12 may be attached to the jet nozzle 30. In this case, a protrusion 32 formed on the surface of the jet nozzle 30 is inserted in a hole 31 formed in the pressure hose 25 and the pressure hose 26 is rotated clockwise so as to be fixed. The first 26*a* of the pressure hose 26 and the pressure hose nozzle 26*b* provided at the tip portion of the hose 26 are removable.

Figure 14:
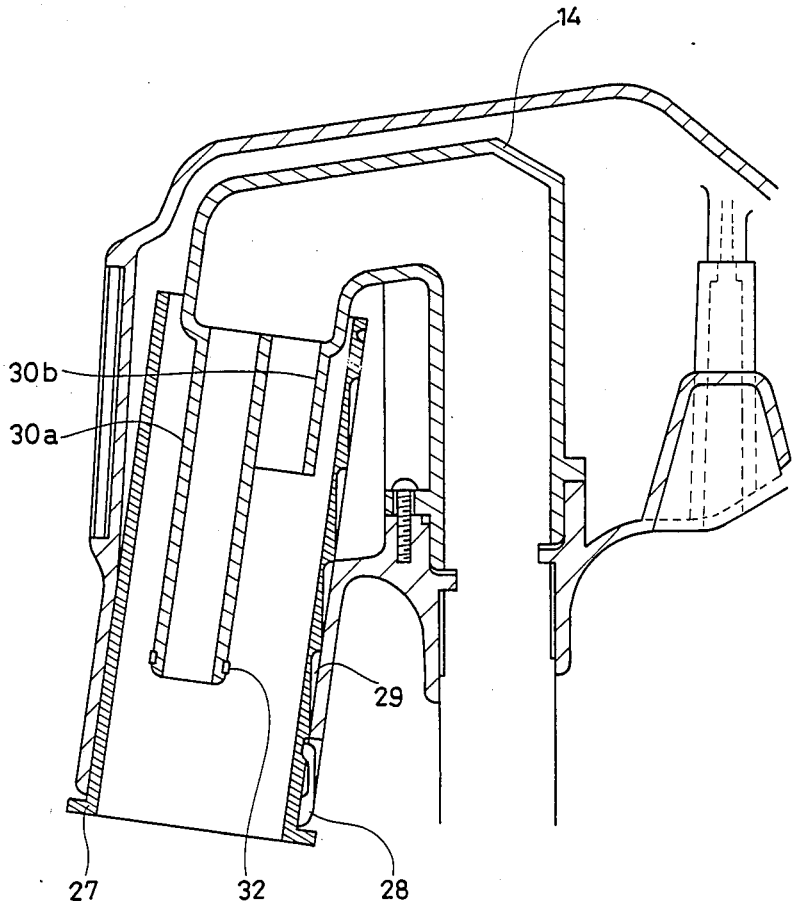
FIG. 14 is a partial enlarged sectional view of an embodiment in which two jet nozzles having different lengths are used instead of the jet nozzle in FIG. 11.

FIG. 14 shows an example using two jet nozzles 30*a* and 30*b* having different lengths in the embodiment shown in FIG. 11, these jet nozzles being similar to those in the embodiment shown in FIG. 8.

Although the pump, the inlet, the outlet pipe, the jet nozzles are contained in one case in the above described embodiments, those components need not be contained in one case and may be connected to form a transportable unit.

Since the present invention is structured to be installed in a transportable manner in which the motor, the pump, the inlet, the outlet pipe are not fixed to any portion of the bathroom, any installation work is not required and accordingly, the time and cost required for such work can be saved. Moreover, since the apparatus of the present invention can be moved within the range of extension of the power cord, cleaning in the bathroom can be made without inconvenience.

In addition, if a flexible outlet pipe is provided as described in one of the preferred embodiments of the present invention, the height of the cylinder can be adjusted according to the level of the water surface in the bathtub and thus the cylinder has always the temperature rising effect.

Furthermore, if jet nozzles formed by a plurality of cylinders are provided as described in another embodiment of the invention, a pressure hose can be connected to shoot out hot water more forcefully in a desired direction with the other jet nozzles supplying jet currents constantly. Thus, by directing the jet current from the pressure hose to the body of a person in the bathtub, healthful effects such as massage, warming and washing will be given to him.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A current and bubble generating apparatus for a body of liquid having a level, said level of said body being selectively variable and said apparatus comprising:

a pump having a liquid inlet for intaking liquid from said body;

outlet means connected to said pump for receiving liquid from said pump;

jet nozzles connected to said outlet means, said nozzles permitting said liquid to issue therefrom into said body in order to create current and bubbles therein, said nozzles including vertically adjustable means so as to be positionable just above said body of liquid for all levels of said body;

silencer means surrounding said nozzles for deadening noise of said liquid issuing from said jet nozzles; and case means for enclosing said pump and a portion of said outlet means, said case means and its contents along with said jet nozzles and said silencer means all being portable.

2. The current and bubble generating apparatus of claim 1, wherein said silencer means is adjustable to permit an end of said silencer means to remain below the level of the liquid regardless of variations in the level.

3. The current and bubble generating apparatus of claim 1, wherein said silencer means encircles said jet nozzles and extends from said jet nozzles to a position below the surface of the body of the liquid.

4. The current and bubble generating apparatus of claim 1, wherein said silencer means intakes air from a chamber and wherein said body of liquid is located in an area separate from the chamber, said air intaken by said silencer means is drawn from this separate chamber such that noise in said area is minimized during operation of said apparatus.

5. The current and bubble generating apparatus of claim 1, further comprising:

a hose detachably connected to each of the jet nozzles, said hose increases pressure of liquid issuing from said jet nozzles.

6. The current and bubble generating apparatus of claim 1, further comprising:

a power supply circuit including at least an isolating transformer for stepping down voltage of a power supply, said power supply being provided outside an area in which the apparatus is operated;

a motor for driving said pump; and a cord for supplying power to said motor from said power supply.

7. A current and bubble generating apparatus for a body of liquid having a level, said level, said level of said body being selectively variable and said apparatus comprising;

a pump having a liquid inlet for intaking liquid from said body;

outlet means connected to said pump for receiving liquid from said pump, said outlet means being adjustable toward and away from said body of liquid;

jet nozzles connected to said outlet means, said nozzles permitting said liquid to issue therefrom into said body in order to create currents and bubbles therein, said nozzles being positioned on said outlet means, and being vertically adjustable therewith to a plurality of fixed, vertical positions just above the body of liquid regardless of the selected level of said body;

a first case for containing said pumb and a first portion of said outlet means; and a second case for containing said jet nozzles and a second portion of said outlet means, said first case and said second case being connected by said outlet means, and both said cases and their contents being portable.

8. The current and bubble generating apparatus of claim 7, wherein said first case is normally placed within said liquid of said body and said second case projects upwardly from the first case, said second case being rotatable around said outlet means.

9. A water current and bubble generating apparatus for a bath, said apparatus generates air bubbles in water contained in the bath by sending jet currents of water therethrough, said apparatus comprising:

a motor;

a pump driven by said motor;

an inlet coupled to said pump;

an outlet pipe having an end coupled to said pump;

jet nozzles coupled to said outlet pipe, said jet nozzles shoot water from said outlet pipe into said bath;

said motor, said pump, said inlet, said outlet pipe and said jet nozzles all being formed as a unitary body which is detachable from said bath and which are all contained in a transportable case, said case comprising a first and a second portion, said first portion contains said motor, said pump, said inlet and a part of said outlet pipe, and said second portion contains another part of said outlet pipe and said jet nozzles, said first case and said second case being connected by said outlet pipe, said first case being placeable in said bath while said second case is supported by said outlet pipe above the water in said bath; and a noise silencer surrounding each of the jet nozzles, said silencer being vertically adjustable.

* * * * *